US009044659B2

(12) United States Patent
Hall

(10) Patent No.: US 9,044,659 B2
(45) Date of Patent: Jun. 2, 2015

(54) SLIP AND COUNTER FIGHT SIMULATION / WORKOUT MACHINE

(76) Inventor: Clarence V. Hall, Plainfield, NJ (US)

( * ) Notice: Subject to any disclaimer, the term of this patent is extended or adjusted under 35 U.S.C. 154(b) by 276 days.

(21) Appl. No.: 13/385,703

(22) Filed: Mar. 2, 2012

(65) Prior Publication Data

US 2013/0231222 A1 Sep. 5, 2013

(51) Int. Cl.

| | |
|---|---|
| ***A63B 69/34*** | (2006.01) |
| ***A63B 69/20*** | (2006.01) |
| ***A63B 69/24*** | (2006.01) |
| ***A63B 71/00*** | (2006.01) |
| *A63B 69/00* | (2006.01) |
| *A63B 71/14* | (2006.01) |
| *A63B 24/00* | (2006.01) |

(52) U.S. Cl.

CPC ..... *A63B 69/34* (2013.01); *A63B 69/0053* (2013.01); *A63B 71/145* (2013.01); *A63B 24/0075* (2013.01); *A63B 2071/0072* (2013.01); *A63B 2071/0081* (2013.01); *A63B 2220/17* (2013.01); *A63B 2220/20* (2013.01); *A63B 2220/801* (2013.01); *A63B 2225/09* (2013.01); *A63B 2225/093* (2013.01)

(58) Field of Classification Search

CPC ..... A63B 69/004; A63B 2244/102; A63B 2244/10; A63B 24/0087; A63B 69/0053; A63B 2220/72; A63B 2244/106; A63B 2071/0655; A63B 2220/833; A63B 2230/50; B25J 9/1676

USPC ..... 482/1, 4, 7–9, 83–90; 463/8; 273/440.1

See application file for complete search history.

(56) References Cited

U.S. PATENT DOCUMENTS

| | | | | |
|---|---|---|---|---|
| 835,796 A * | 11/1906 | Lindsley | ..... | 482/83 |
| 2,909,370 A | 10/1959 | Fortney | ..... | 482/83 |
| 3,250,533 A | 5/1966 | Nicholson | ..... | 482/83 |
| 3,804,406 A | 4/1974 | Viscione | ..... | 482/4 |

(Continued)

FOREIGN PATENT DOCUMENTS

| | | | |
|---|---|---|---|
| EP | 0557264 A2 | 8/1993 | |
| WO | WO 2012089194 | 7/2012 | ..... A63B 69/201 |

OTHER PUBLICATIONS

"Cardio Exercise Equipment" found at http://www.dailymotion.com/video/xc2rtn_cardio-exercise-equipment-cardio-bo_sport.

(Continued)

*Primary Examiner* — Oren Ginsberg
*Assistant Examiner* — Joshua Lee
(74) *Attorney, Agent, or Firm* — Ernest D. Buff & Assoc. LLC; Ernest D. Buff; Margaret A. LaCroix

(57) ABSTRACT

A slip and counter fight simulation apparatus has a plurality of arms that move in random/programmable fashion, directing jabs, hooks and upper-cut punches at an individual to thereby promote physical fitness, and provide fight training and/or fight simulations. The fight simulation apparatus comprises at least two substantially parallel opposing side walls. Each side wall includes at least three height-adjustable arms that traverse separate slots and are substantially parallel to one another. A glove appendage member is located on a proximate end of each of the arms. At least one counter area/element is provided. The arms are constructed and arranged to provide different punch configurations, including hook punches, straight punches or uppercuts and uppercut type punches, respectively.

14 Claims, 6 Drawing Sheets

(56) References Cited

U.S. PATENT DOCUMENTS

| | | | | | |
|---|---|---|---|---|---|
| 4,088,315 | A | | 5/1978 | Schemmel | 482/4 |
| 4,353,545 | A | * | 10/1982 | Anderson | 482/4 |
| 4,491,324 | A | | 1/1985 | Yoshida | 463/8 |
| 4,765,609 | A | | 8/1988 | Wilson et al. | 482/83 |
| 4,819,934 | A | | 4/1989 | Wilson et al. | 482/83 |
| 5,052,683 | A | | 10/1991 | Wang et al. | 482/7 |
| 5,100,138 | A | * | 3/1992 | Wilde | 273/440.1 |
| 5,281,191 | A | * | 1/1994 | DeSousa | 482/83 |
| 5,419,749 | A | | 5/1995 | Morgenstein | 482/99 |
| 5,613,925 | A | * | 3/1997 | Miasserian | 482/83 |
| 5,700,230 | A | * | 12/1997 | Cardona | 482/83 |
| 5,735,775 | A | | 4/1998 | Miasserian | 482/83 |
| 5,803,877 | A | * | 9/1998 | Franey | 482/83 |
| 5,888,152 | A | * | 3/1999 | Rogers et al. | 473/440 |
| 6,110,079 | A | | 8/2000 | Luedke et al. | 482/83 |
| 6,152,863 | A | | 11/2000 | Nelson et al. | 482/83 |
| 6,165,068 | A | | 12/2000 | Sonoda et al. | 463/8 |
| 6,336,891 | B1 | * | 1/2002 | Fedrigon et al. | 482/8 |
| 6,348,028 | B1 | | 2/2002 | Cragg | 482/148 |
| 6,416,445 | B1 | | 7/2002 | Nelson et al. | 482/83 |
| 6,685,581 | B2 | | 2/2004 | Krause et al. | 473/445 |
| 6,896,630 | B1 | * | 5/2005 | Breining | 473/422 |
| 7,041,039 | B2 | * | 5/2006 | Wang et al. | 482/87 |
| 7,329,210 | B1 | * | 2/2008 | Marano | 482/83 |
| 7,371,164 | B2 | | 5/2008 | Ueshima | 463/8 |
| 7,789,810 | B2 | * | 9/2010 | Le | 482/83 |
| 8,025,612 | B1 | * | 9/2011 | Buzzanco et al. | 482/83 |
| 8,079,938 | B2 | * | 12/2011 | Jones et al. | 482/8 |
| 2004/0248633 | A1 | * | 12/2004 | Trawick et al. | 463/8 |
| 2006/0252608 | A1 | * | 11/2006 | Kang et al. | 482/84 |
| 2006/0258515 | A1 | * | 11/2006 | Kang et al. | 482/83 |
| 2010/0179031 | A1 | * | 7/2010 | Luigi | 482/89 |
| 2011/0059827 | A1 | * | 3/2011 | Fazio | 482/83 |
| 2011/0067521 | A1 | * | 3/2011 | Linn et al. | 74/490.06 |
| 2011/0264266 | A1 | * | 10/2011 | Kock | 700/253 |
| 2011/0295399 | A1 | * | 12/2011 | Plociennik et al. | 700/97 |
| 2012/0108394 | A1 | * | 5/2012 | Jones et al. | 482/8 |
| 2013/0065731 | A1 | * | 3/2013 | Jones et al. | 482/8 |
| 2014/0039680 | A1 | * | 2/2014 | Angle et al. | 700/259 |

OTHER PUBLICATIONS

"Don King Boxing game Wii" found at http://www.gamespot.com/wii/sports/don-king-boxing/index.html.

* cited by examiner

SLIP AND COUNTER FIGHT SIMULATION / WORKOUT MACHINE

BACKGROUND OF THE INVENTION

1. Field of the Invention

The present invention relates to sports training devices; and, more particularly, to a slip and counter fight simulation and workout machine that promotes physical fitness, and provides fight training and/or fight simulations.

2. Description of the Prior Art

Boxing, fighting and karate arts involve martial training for sport, self-defense, and/or physical fitness. Kick-boxing and boxing have gained more popularity in the past several years owing to physical fitness and weight loss benefits imparted through the discipline. Increasingly, people of all ages are discovering the benefits derived from boxing or fighting, or self-defense training when developing self protection skills.

Often in sports training, exercising and self-defense instruction for an individual utilizes a punching bag or the like to practice punching and/or kicking. However, in this manner the individual is generally the sole participant and does not have to return punches or kicks. Although the use of a punching bag or punching device provides a good work-out, the device does not provide any skill teaching methods for knocking-out an adversary, or for dodging or defending against punches or kicks.

Another form of training in sport boxing, exercising and/or self-defense instruction involves a close contact sport wherein two individuals in a ring participate in a sparring match. While highly effective, there can be problems with finding a sparring partner and particularly, finding a sparring partner having a complementing skill level. Moreover, the actual person to person contact can sometime result in injuries.

Various devices have been heretofore disclosed and utilized for providing fight/boxing training and/or workouts. A number of devices generally include a boxing dummy, full body devices simulating a person, or sparing device, wherein a right and left arm with gloves are extended from a torso and some sort of mechanism is provided so that the arms move outwardly and upwardly if at all. Generally, only two arms are provided. As a result the mechanism can only deliver a very limited type of punch and punching range. Even where more than one type of arm is provided, the arms have a very limited range of motion and cannot be adjusted to accommodate specific needs of a plethora of individuals.

There remains a need in the art for an exercise apparatus that incorporates boxing and kick-boxing fitness features, and comprises a plurality of moving arms spaced at intervals that deliver different punches and/or defensive moves. Further, there exists a need in the art for an exercise fight simulation apparatus that can be adjusted to meet specific training and fitness needs of each individual.

SUMMARY OF THE INVENTION

The present invention is directed to a slip and counter machine comprising a fight simulation apparatus that incorporates boxing and kick-boxing fitness features. A plurality of moving arms spaced at intervals deliver different punches and/or defensive moves. It is noted that preferably the arms are not to be hit or kicked, as same could potentially break the arms. The slip and counter machine incorporates a fight simulation apparatus that is readily adjusted to meet specific training and fitness needs of each individual. Usage of the fight simulation apparatus spans substantially the entire range from novice to pro; is particularly well suited for educating, training and/or challenging users. Specific applications also include assisting individuals during training for self-defense, so that the trainee becomes empowered to protect himself/herself.

The fight simulation/workout machine includes a) at least two side walls and a bottom floor mat, b) each side wall including three height-adjustable arms traversing slots, c) a glove appendage member being located on a proximate end of each of said arms, d) at least one counter area/counter element, and e) the arms being located on the side walls and arranged in a manner as to provide different punch configurations, including hook punches, straight punches or uppercuts and uppercut type punches, respectively. Further embodiments of the fight simulation/workout machine include the construction of the glove appendage member that is removable and composed of different grade materials/softness (i.e. pillow soft, soft, medium, hard); configuration of the arms: with a first and third arm including an elbow joint, and the second/middle arm being straight; configuration of the counter area/element, and preferably presentation of at least two counter areas/elements, including a head counter area/element and a mid/stomach counter area/element; and specific elements concerning the control and activation of the machine (i.e. sensor, on/off switch, and the like).

A method of using the fight simulation/workout machine is also provided. The method includes the steps of: (a) determining a height of a user who is adapted to use the machine; (b) adjusting heights of the arms in relation to the height of the user; (c) adjusting length and angels of the arms in relation to the height of the user; (d) activating the machine into an on/off position; and (d) delivering punches of varying types to the user based on the arms. The fight simulation/workout machine comprises at least two substantially parallel opposing side walls; each side wall including at least three height-adjustable arms traversing separate slots and being substantially parallel to one another; a glove appendage member located on a proximate end of each of the arms; at least one counter area/element; and the arms providing different punch configurations, including hook punches, straight punches or uppercuts and uppercut type punches, respectively.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

The present invention is directed to a slip and counter machine that comprises a fight simulation apparatus for use in physical fitness, fight training and/or fight simulations. Generally stated, a plurality of arms move in random or programmable fashion, directing jabs, hooks and upper-cut punches at an individual. It is noted that preferably the arms are not to be hit or kicked, as same could potentially break the arms. The slip and counter machine incorporates a fight simulation/workout machine that includes at least two side walls and a bottom floor mat. Each side wall includes three height-adjustable arms traversing slots. A glove appendage member is located on a proximate end of each of the arms. The machine includes least one counter area/element. The arms are located on the side walls and arranged in a manner that provides different punch configurations, including hook punches, straight punches or uppercuts and uppercut type punches, respectively. Further embodiments of the fight simulation/workout machine concern the construction of the glove appendage member. In these embodiments, the glove appendage member is removable and composed of different grade materials/softness (i.e. pillow soft, soft, medium, hard). Other embodiments involve the configuration of the arms: with a first and third arm including an elbow joint, and the second/middle arm being straight. Further embodiments involve the configuration of the counter area/element, and the presence of at least two counter areas/elements, one of which comprises a head counter area and another of which comprises a mid/stomach counter area. Still other embodiments involve specific elements concerning the control and activation of the machine (i.e. sensor, on/off switch, and the like).

The slip and counter fight simulation/workout machine is ideally suited for installation in a gym, workout center, or private home. It contains a number of arms that move in random fashion, directing jabs, hooks and upper-cut punches at an individual ("User") that stands between the moving arms. The machine can operated at a slow speed for training purposes; at a medium speed as training progresses; or at a higher speed for skilled individuals that wish to perfect and maintain their skills.

Figure 1A:
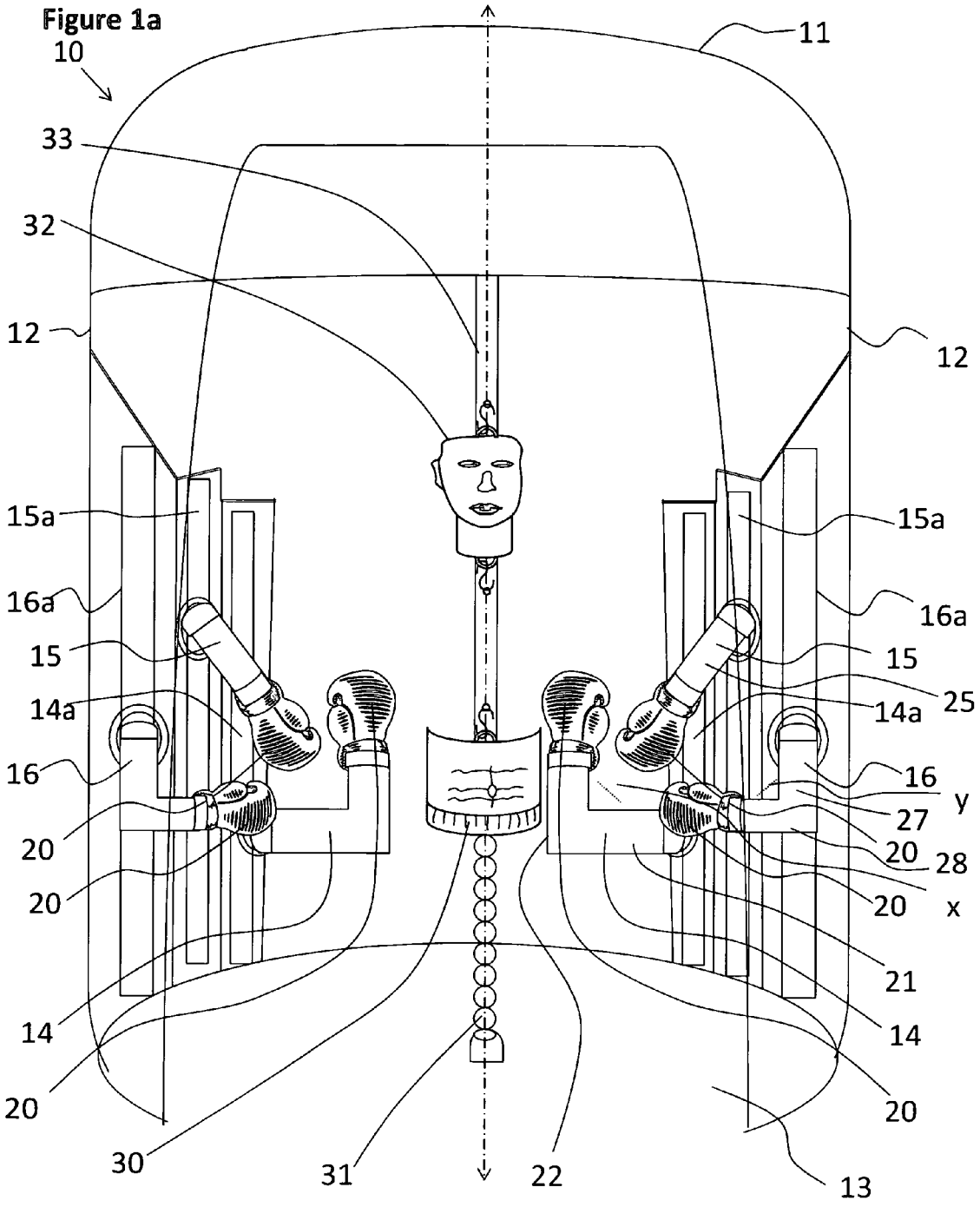
FIG. 1*a* illustrates a perspective view of an embodiment of the fight simulation apparatus of the subject invention.
Figure 1B:
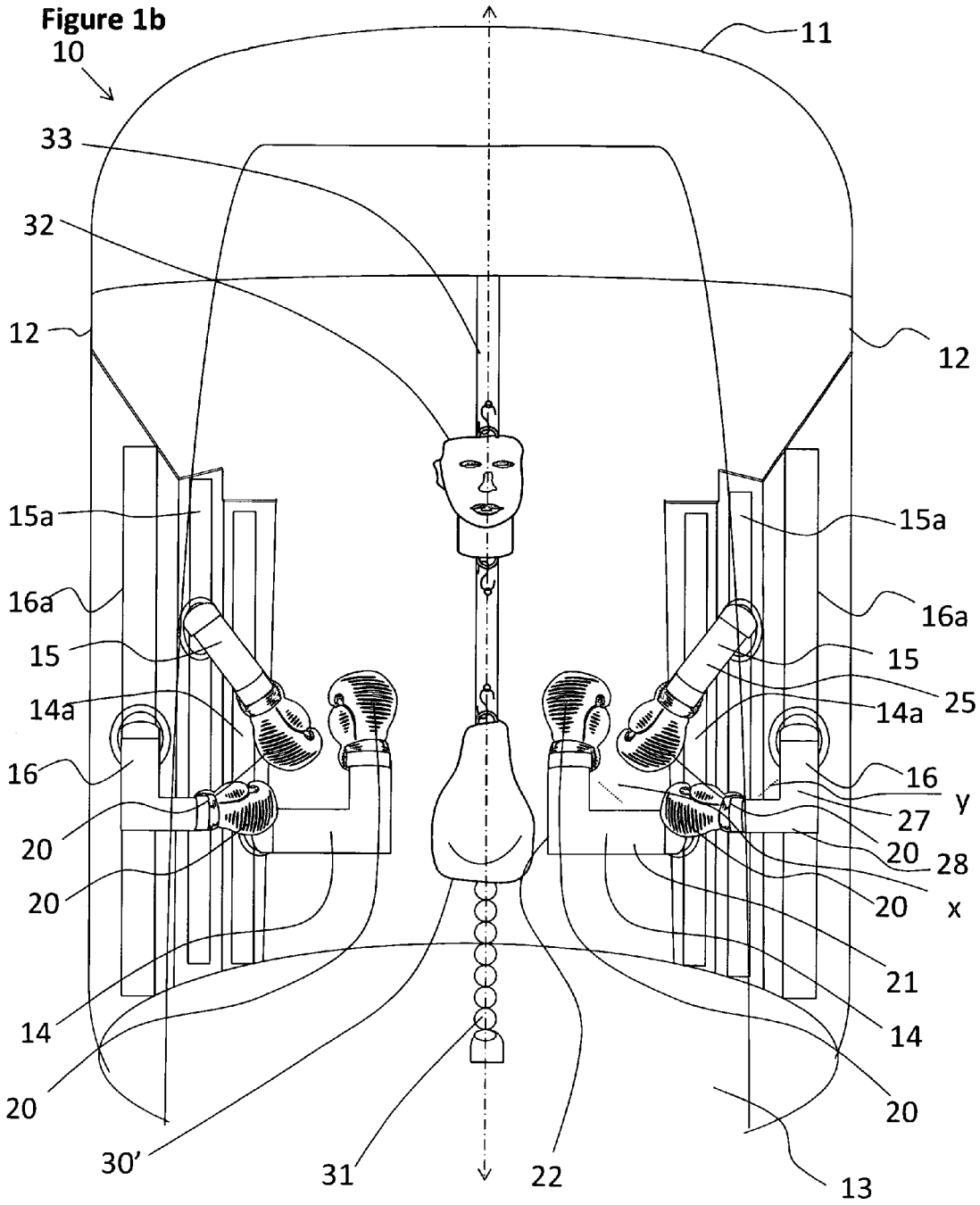
FIG. 1*b* illustrates the perspective view of the embodiment of FIG. 1*a*, however with a round or punch-able mid section counter area/element.

FIG. 1*a* illustrates a perspective view of an embodiment of the fight simulation/workout machine, shown generally at 10. FIG. 1*b* illustrates the perspective view of the embodiment of FIG. 1*a*, however with a round or punch-able mid/stomach section counter area/element. Referring to FIGS. 1*a* and 1*b*, the fight simulation/workout machine 10 generally includes a U-Shaped construct having a top wall 11, at least two parallel side walls 12 arranged opposite from one another, and a bottom floor mat 13. As used herein, the term "U-Shaped" is meant to be a ground view of the device 10 as one stands directly in front of the device 10. In this manner, a user is appointed to walk into the U-shape between the side walls 12 and is thus substantially surrounded by the device. That is to say, the user's front, and sides are in proximity with the side walls 12 of the device as the user walks inside the U-shape; providing a device 10 having side walls 12 forming an arc ranging from about 90 degrees up to about 270 degrees. Preferably, the side walls 12 are arced or curved and form a semi-circle of about 180 degrees. In this manner, fight simulation is optimized to substantially surround a user who walks into the U-shaped device (sides and front of user).

Bottom floor mat 13 may include a sensor therein for activating or turning on the machine 10. Alternatively, the device may be constructed without a bottom floor mat 13 and instead there may simply be a sensor beam located near the bottom of one or more of the side walls 12, or top wall 11. It is further contemplated that the device may be constructed without a top wall 11. In any event, the device includes side walls 12 constructed in a manner so that a user can step into the device 10 and the side walls 12 substantially surround the user in that the side walls 12 are located on the sides and front of the user.

Within side walls 12 there are a series of arms 14, 15, 16 extended within first, second and third slots 14*a*, 15*a*, 16*a*, respectively, that allow the arms to adjust height wise from the floor mat 13, on a substantially vertical plane. The slots 14*a*, 15*a*, 16*a* or tracks are located substantially parallel to one another and are substantially perpendicular to the bottom floor mat 13. Preferably there are three arms 14, 15, 16 as shown, each located in separate slots 14*a*, 15*a*, 16*a* and each being capable of being adjusted along the vertical plane extending from the floor/ground level/or bottom floor mat 13. Each of the arms 14, 15, 16 are spaced and constructed to deliver different punch types/provide different extension ranges for delivery of different punches, as discussed hereinafter.

The arms 14, 15, 16 are provided within slots 14*a*, 15*a*, 16*a* so that the arms 14, 15, 16 vertically traverse the slots 14*a*, 15*a*, 16*a* to accommodate users of varying heights. The arms and slots may include tongue and groove mating means, with teeth and mating slots. Alternatively, hydraulics and/or electronics may be used for movement of the arms 14, 15, 16 along slots 14*a*, 15*a*, and 16*a*.

Each of the arms 14, 15, 16 includes a glove appendage member 20 thereon. Preferably, glove appendage members 20 are removable and different grade glove members 20 are provided, including pillow soft, soft, medium, hard.

Figure 4:
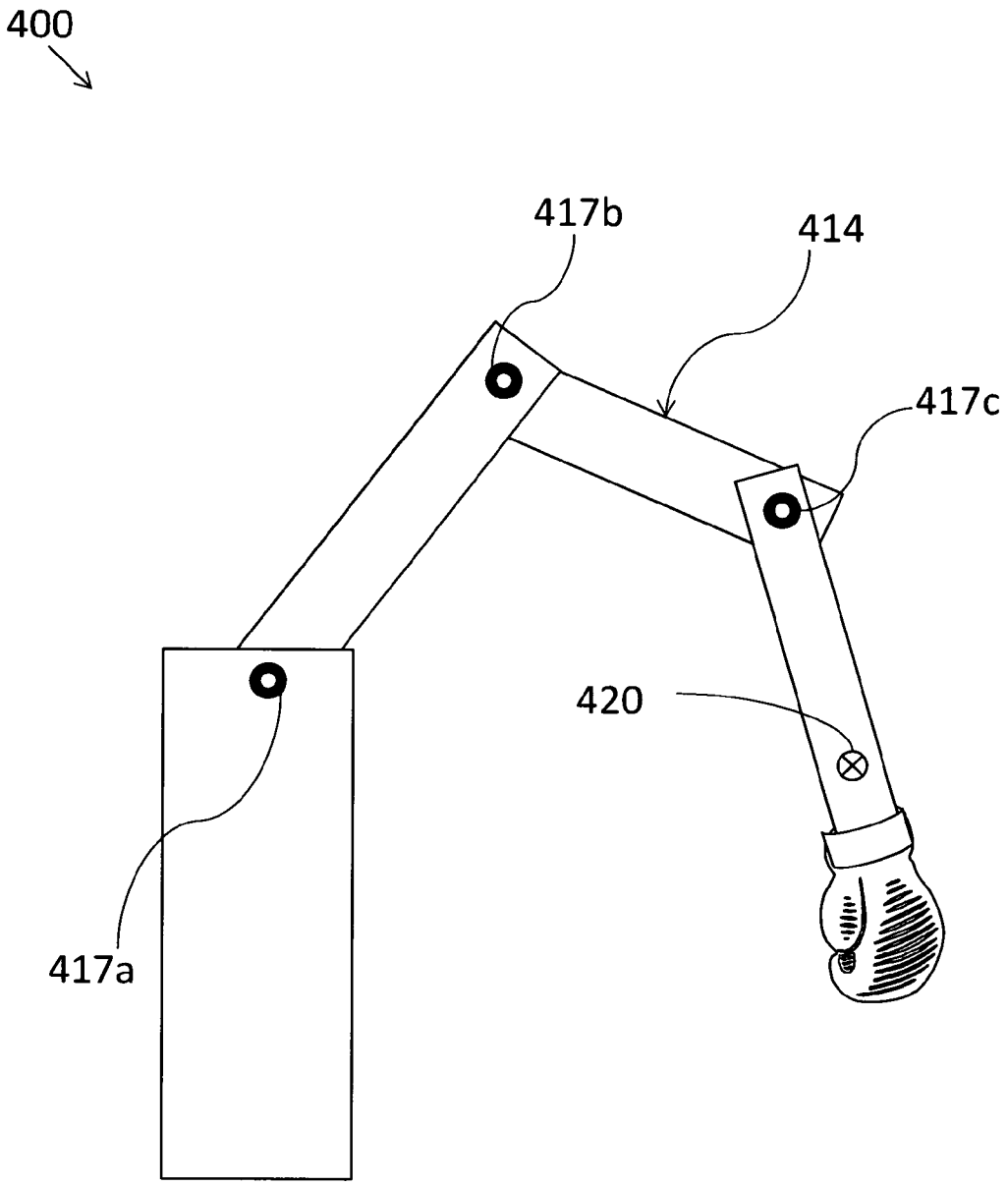
FIG. 4 illustrates a view of a left hook arm, showing flexible joints.

Arm 14 includes at least on elbow joint connecting an upper arm portion 21 and a lower arm portion 22 and provides an angle x located there between. FIG. 4 illustrates arm 14, 16 jointed configurations. Arm 14 is appointed to deliver uppercut type punches. Arm 16, like arm 14, includes an elbow joint connecting an upper arm segment 27 and a lower arm segment 28 and provides an angle y located there between. Arm 16 is appointed to deliver hook type punches. Advantageously, the purpose for the elbow joints on the hook arms 16 are for tighter hooks, in case a user prefers fighting up close. The purpose for the elbow joints on the uppercut arms 14 is so the half uppercut-half hook punch can be thrown.

Figure 2:
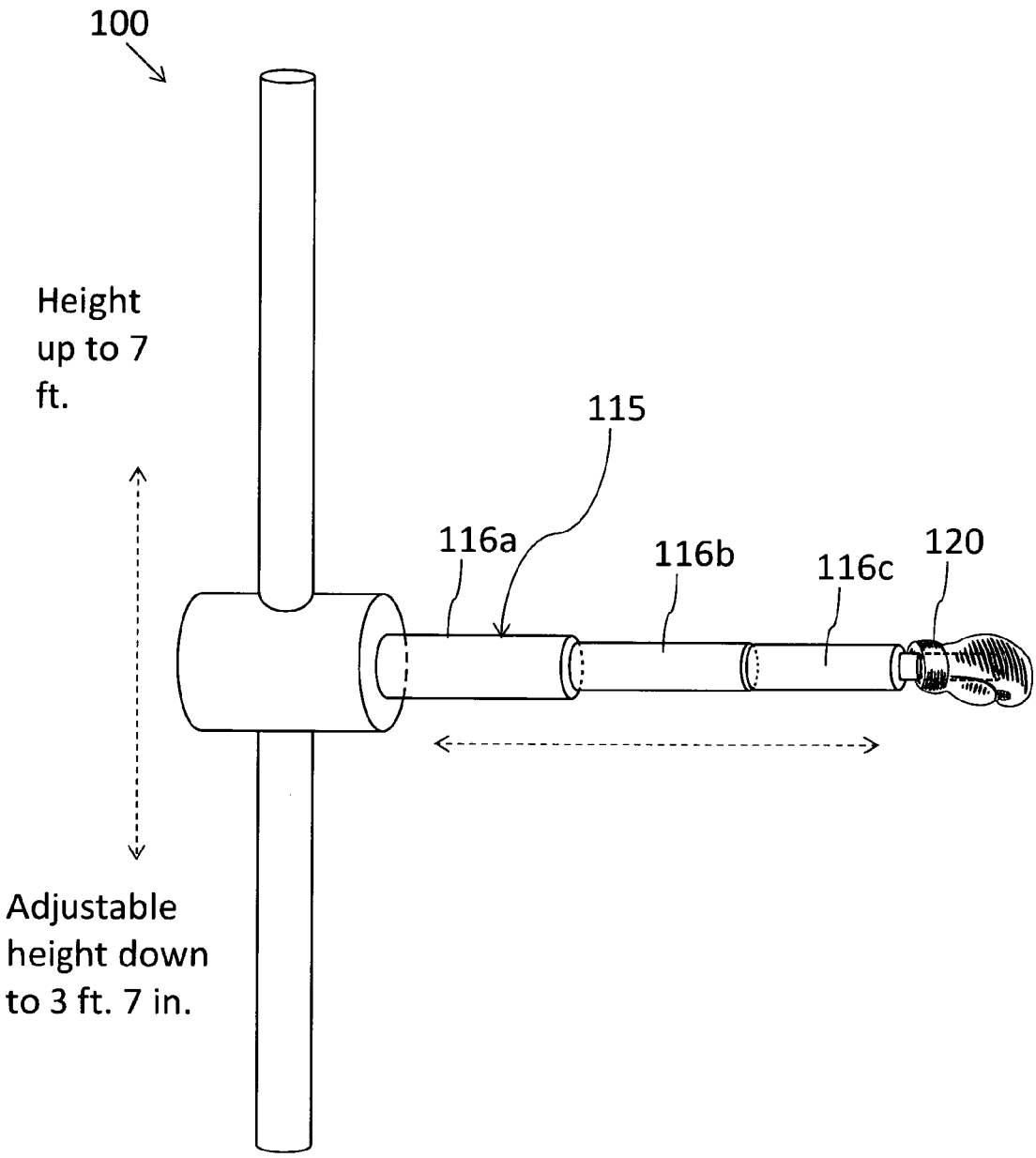
FIG. 2 illustrates a view of a center arm or straight punch arm wherein the arm is telescoping for length extension.
Figure 3:
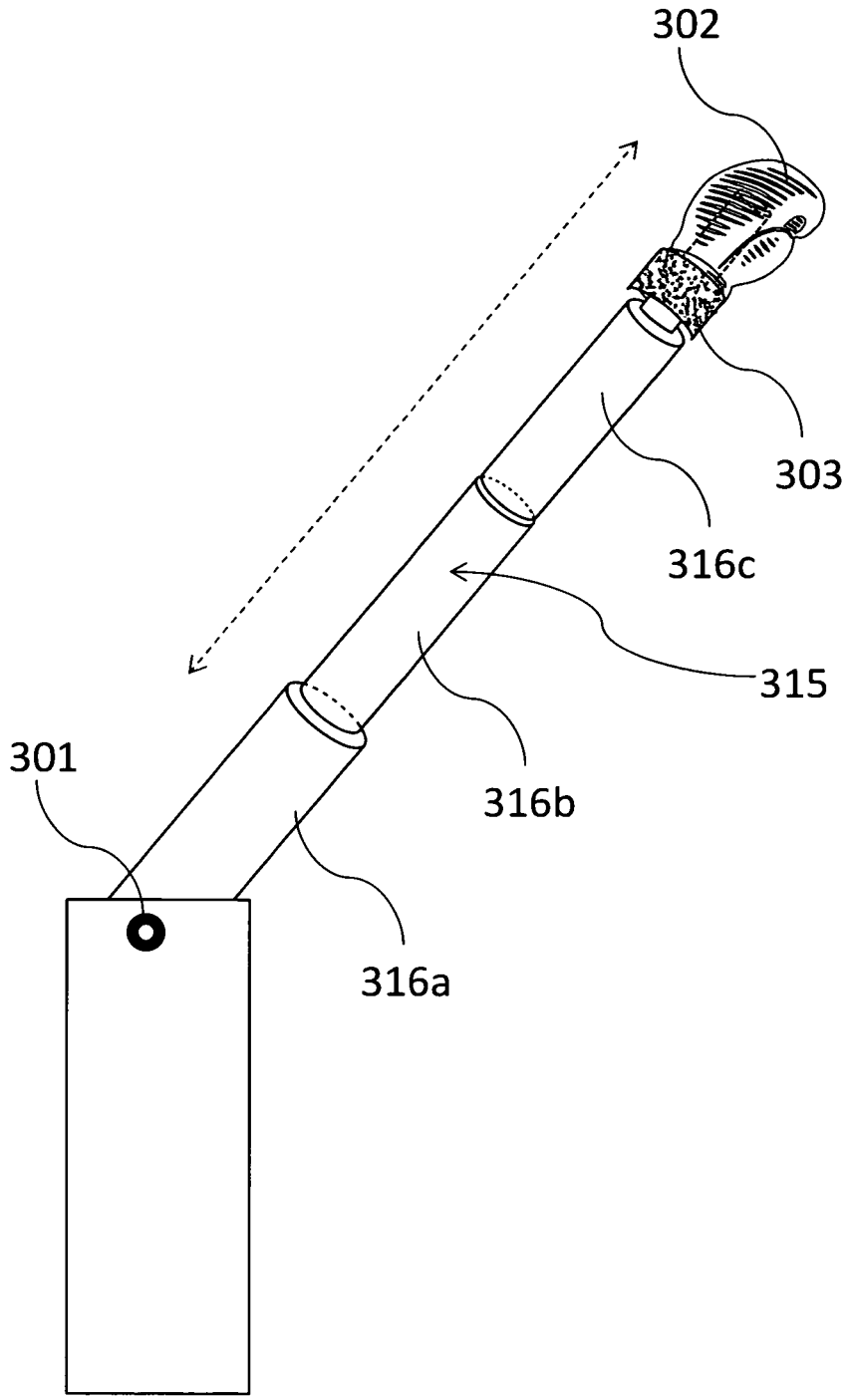
FIG. 3 illustrates a view of a center arm or straight punch arm wherein the arm is telescoping for length extension and is provided with a flexible joint at the slot—arm interface.

In contrast, arms 15, located centrally between arms 14 and 16, and are preferably constructed on as straight members 25 that are angled downward (or upward) from side walls 12. Preferably, arms 15 slant or angle toward the center of the device 10 and said angle is adjustable as illustrated by way of FIG. 3. As so constructed, arm 15 delivers straight punches. Preferably, arms 15 are provided as telescoping arms as shown in FIGS. 2 and 3.

Continuing with FIGS. 1*a* and 1*b*, counter areas/elements are provided, generally including a mid/stomach section counter area/element 30 (30' in FIG. 1*b*: providing a punch-able element like structure embodiment) having a strong cable 31 on it so that it does not move, and a head counter area/element 32 having rubber straps 33 so that it can move a little more, but not as much as a double end bag. Cable 31 may be composed of a flexible material so that the cable 31 gives a little to avoid hurting the user's wrists; alternatively, cable 31 may be composed of a rigid material but in such an event cable 31 has some slack in order to give so it won't hurt the user's wrists. The counter areas are to be positioned in the back and center of the machine, the same way a user's body would be behind his/her arms in the fighting position.

The machine is preferably constructed having a U-shaped or arc-shaped construction. The uppercut slot 14*a* for the uppercut arm 14 is located the furthest away from the user and the closest arms towards the back of the device 10, close to the counter areas/elements. The second or middle slot 15*a* is appointed to deliver straight punches via the straight arm 15. The third slot 16*a* is for holding hook arm 16 and for thus delivering deliver hook type punches. The straight arms 15/second slot 15*a* are preferably straight arms that go toward the center in a slant. The machine is approximately seven feet high so that the device can be utilized by users of varying heights. All six arms are able to go very low or are able to be adjusted to low levels, down to approximately 3 feet and 7 inches from the bottom mat 13. The slots 14*a*, 15*a*, 16*a* are designed to have the capability to make the arms 14, 15, 16 work in a one foot position as well for small kids and people. Accordingly, the machine has a height range for the arm movement extending from 3 feet, 7 inches up to 7 feet.

The arms can be moved to heights located there between to adjust to the height or arm range of the user. The arms have the ability to work in a downward slant and upward slant so that a user can practice fighting people shorter and/or taller than himself or herself. The straight middle arms (15) can be adjusted down low and slant in an upward position, for a taller person to practice fighting a shorter person. Also, preferably the hook arms and the uppercut arms (16, 14, respectively) have elbow joints, more significantly the uppercut arms, so that the machine can throw a half hook/half uppercut punch.

The machine is in communication with a power source, and may include a manual on/off power switch or a sensor can activate the machine. A control panel may be provided that allows some of the arms to be turned off, while others are on so that a user can just work on hooks, etc. The machine may be programmed to carry out random maneuvers or unpredictable combinations, or programmed to utilize pre-programmed combinations and/or workout or practice routines. What is more, the machine control pad includes different speeds and user levels, including slow, fast, faster, pro speeds; and/or levels of beginner, intermediate, or advanced.

Counter areas/elements are preferably made in the shape of a human stomach. These counter elements can alternatively comprise circular counter spots, and the shape of the areas/elements can be hexagonal with counter spots thereon. In one embodiment, there are only two areas/elements: a mid section (stomach area) area/element having a strong cable on it so that it does not move and preferably resembling an oblong oval or pear corresponding to the look of a portly belly area on a person, and a head counter area/element having rubber straps so that it can move a little more, but not as much as a double end bag. The counter areas/elements are to be positioned in the back and center of the machine, the same way a user's body would be behind his/her arms in the fighting position. The counter areas/elements should come with different cables and different rubber straps, for different height/sized customers.

The arms include removable gloves that may be screwed on or snapped on or placed over the arms. The gloves are durable and stay secured during use. The purpose of the removable gloves is that the gloves can be composed of different materials or flexibility levels. For example, customers who are afraid or can't withstand a punch can put on the safe optional cushioned type of glove. Harder gloves can be provided for more advanced users.

FIG. 2 illustrates a view of a center arm or straight punch arm wherein the arm is telescoping for length extension, shown generally at 100. As herein illustrated, straight arm 115 (arm 15 in FIG. 1) located centrally to the other arms, preferably includes telescoping members 116*a-n*. Telescoping members 116*a-n* slide within each neighboring member so that the arm 115 can be extended lengthwise. The members 116*a-n* may include locking mechanisms and marking or measuring mechanisms for length adjustment. Preferably, to ensure a user does not get injured, a sensor 120 is incorporated in the wrist area of all the six arms, as indicated herein. The sensor 120 assures that the mechanical arms stop at roughly one foot from the user. Pillow soft gloves for example should be about one foot two inches long on all six arms.

FIG. 3 illustrates a view of a center arm or straight punch arm 315 (arm 15 of FIG. 1) wherein the arm is telescoping for length extension and is provided with telescoping members 316*a-n* attached to a flexible joint 301 at the slot—arm interface. Pillow gloves 302 should be about one foot 2 inches long. A sensor 303 is provided at the wrist of the glove for preventing actual contact or to mitigate contact force. As sensor 303 senses the user's body within close proximity the arm movement slows or stops to prevent or mitigate contact force. The position of the arm as shown in the figure illustrates an example of when a tall person sets the angle and height extension of arm 315 as if practicing to fight a shorter person and vice versa.

FIG. 4 illustrates a view of a left hook arm, showing flexible joints, shown generally at 400. Left hook arm 414 is appointed to deliver uppercut type punches. Arm 414 includes at least one elbow joint 417*a-n* and wrist sensor 420. The purpose for the elbow joints is to provide tighter hooks, in case a user prefers fighting up close.

Figure 5:
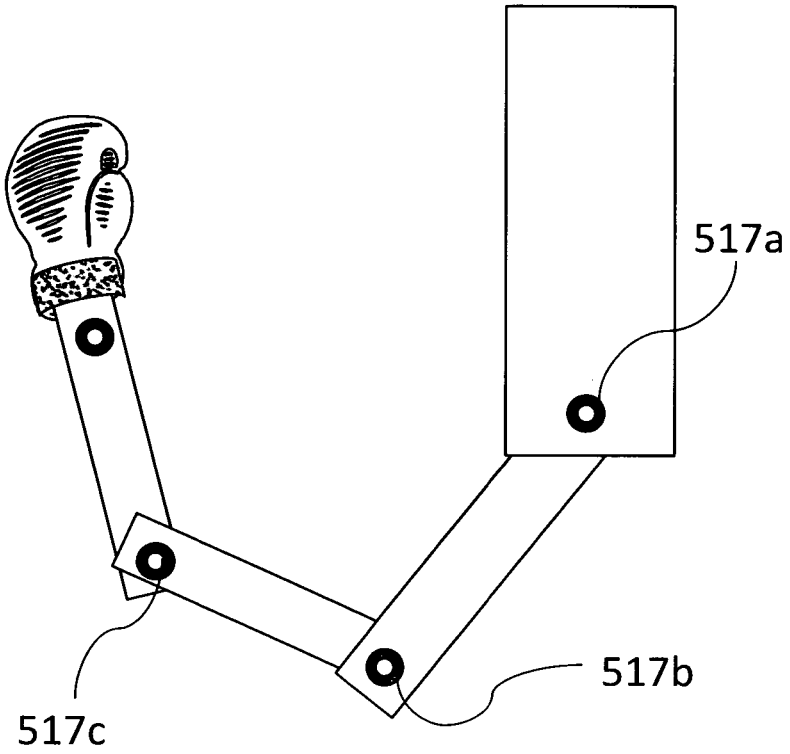
FIG. 5 illustrates a view of a left upper-cut arm, showing flexible joints.

FIG. 5 illustrates a view of a left upper-cut arm, showing flexible joints 517*a-n*.

The machine is preferably shaped like a capital letter D without the straight line, or a U-shape, like a boomerang shape. The straight arms should have the ability to change reach for different size users. For example, various fighters have varying arm reaches: 80" reach (taller users), 72" reach (average height male), 65" reach (for smaller users), 60" reach, and 52" setting (for small users). A sensor may be integrated into the floor matt of the machine that triggers the machine into the on position and activates the arms. The sensor can begin after a time interval, such as 3-2-1, in order for the user to get ready for the simulation.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A fight simulation workout machine comprising:

a. at least two substantially parallel opposing side walls;

b. each side wall including at least three height-adjustable arms that traverse separate slots within each side wall;

c. a glove appendage member located on a proximate end of each of said arms;

d. at least one counter area/element;

e. at least one contact sensor appointed to stop or decrease movement of said arms when a user's body is sensed in close proximity;

f. specific elements concerning the control and activation of the workout machine for activating a power source in communication with said machine; and g. a bottom floor mat;

wherein said arms provide different punch configurations, such as hook punches, straight punches or uppercuts and uppercut type punches.

2. A fight simulation workout machine as recited by claim 1, wherein said bottom floor mat includes a sensor for activating a power source in communication with said machine.

3. A fight simulation workout machine as recited by claim 1, wherein a first arm is constructed having at least one joint separating a segment providing bending capability to said first arm.

4. A fight simulation workout machine as recited by claim 1, wherein a first arm is a hook punching arm.

5. A fight simulation workout machine as recited by claim 1, wherein a second or center arm located between said other arms is a straight arm member angled relative to said side walls.

6. A fight simulation workout machine as recited by claim 1, wherein a third arm is constructed having at least one joint separating a segment providing bending capability to said third arm.

7. A fight simulation workout machine as recited by claim 1, wherein a third arm is an uppercut punching arm.

8. A fight simulation workout machine as recited by claim 1, wherein a second or center arm comprises telescoping members for length extension.

9. A fight simulation workout machine as recited by claim 1, wherein said glove appendage members are removable.

10. A fight simulation workout machine as recited by claim 1, wherein said glove appendage members are composed of different grade materials/softness (such as pillow soft, soft, medium or hard grade materials, or combinations thereof).

11. A fight simulation workout machine as recited by claim 1, wherein a first and third arm include at least one elbow joint.

12. A fight simulation workout machine as recited by claim 1, wherein there are preferably at least two counter areas/elements provided as a head counter area/element and a mid counter area/element.

13. A fight simulation workout machine as recited by claim 1, wherein said sensor is a heat sensor.

14. A fight simulation workout machine as recited by claim 1, wherein said sensor is located in a wrist region of each of said arms and near said gloves.

* * * * *